United States Patent [19]

Kim

[11] Patent Number: 5,007,145

[45] Date of Patent: Apr. 16, 1991

[54] END-LOCKING DEVICE FOR SLIDE FASTENERS

[76] Inventor: Sam H. Kim, 43-3, Myungju-dong, Kangneung-si, Kangwon-do, 210-30, Rep. of Korea

[21] Appl. No.: 411,451

[22] PCT Filed: Jan. 18, 1989

[86] PCT No.: PCT/KR89/00001

§ 371 Date: Sep. 18, 1989

§ 102(e) Date: Sep. 18, 1989

[87] PCT Pub. No.: WO89/06504

PCT Pub. Date: Jul. 27, 1989

[30] Foreign Application Priority Data

Jan. 18, 1988 [KR] Rep. of Korea ..... 1988-348

[51] Int. Cl.[5] ..... A44B 19/38

[52] U.S. Cl. ..... 24/433; 24/388

[58] Field of Search ..... 24/433, 434, 388, 390

[56] References Cited

U.S. PATENT DOCUMENTS

| | | | |
|---|---|---|---|
| 2,123,513 | 7/1938 | Marinsky | 24/388 |
| 2,241,841 | 5/1941 | Beckwith | 24/433 |
| 2,358,179 | 9/1944 | Marinsky | 24/433 |
| 2,974,382 | 3/1961 | Carlile | 24/433 |
| 3,775,812 | 12/1973 | Carver, Jr. | 24/433 |
| 4,221,026 | 9/1980 | Kanzaka | 24/433 |
| 4,232,430 | 11/1980 | Friedberg | 24/388 |
| 4,660,258 | 4/1987 | Horita | 24/433 |

FOREIGN PATENT DOCUMENTS

| | | | |
|---|---|---|---|
| 0865131 | 1/1953 | Fed. Rep. of Germany | 24/433 |
| 0980925 | 5/1951 | France | 24/433 |
| 1174218 | 12/1969 | United Kingdom | 24/433 |

*Primary Examiner*—Victor N. Sakran

*Attorney, Agent, or Firm*—Sterne, Kessler, Goldstein & Fox

[57] ABSTRACT

An end-locking device for slide fasteners which enables the end of a first row of zipper teeth to be releasably locked in a socket terminal which is fixed to the end of a second row of zipper teeth. The device includes locking means mounted to pivot on the socket terminal and engaging means located at the end of the second row of zipper teeth. When the end of the first row of zipper teeth is inserted into the socket terminal in order to fasten the zipper, the locking means and the engaging means are brought into interlocking engagement with each other and held in the socket terminal. In order to unfasten the zipper, the locking means is manually pushed and this causes the ends of the rows of zipper teeth to be disengaged, thereby permitting the end of the second row of zipper teeth to be escaped from the socket terminal.

18 Claims, 6 Drawing Sheets

END-LOCKING DEVICE FOR SLIDE FASTENERS

BACKGROUND OF THE INVENTION

1. Field of the Invention

The present invention relates to an end-locking device for a separable slide fastener of the type commonly known as a zipper. In particular, the invention relates to an end-locking device which enables the end of a first row of zipper teeth to be releasably locked in a socket of a terminal which is fixed to the end of a second other releasable row of zipper teeth, This is achieved by inserting the end of the first row into the socket through its entrance of the socket such that the rows of teeth are aligned for mating and by providing a releasable locking member for releasably retaining said first end in said socket.

2. Description of the Prior Art

In conventional slide fasteners, it is necessary to make sure that both ends of rows of zipper teeth meet in the socket carried by one of two terminal pins before fastening the zipper teeth of one row to the zipper teeth of the other row. It is necessary to hold the end of a row of zipper teeth in the socket so that the end may not escape out of the socket and when the slider is moved to cause the zipper teeth to mate.

In this manner, the opposed rows of zipper teeth are brought into interlocking engagement. Disengagement of the teeth of this zipper is achieved by moving the slider toward the socket. To complete the release of the ends of the zipper, a terminal pin which is located at the end of one row of zipper teeth must be intentionally pulled out of the socket, in which it has been mounted.

If the free end of the row of zipper teeth is not fully inserted into the socket, the slider cannot cause the zipper teeth of one row to mate properly with the teeth of the other row because the first tooth of one row will not be properly aligned with the first tooth of the other row. Further, if the end of the row which is inserted into the socket is not held firmly in the socket, the forward movement of the slider is likely to pull the inserted end out of the socket, thus preventing the correct fastening of the zipper, or the correct interlocked connection of first teeth such that the first teeth may separate and the rows of teeth may come apart behind the slider.

SUMMARY OF THE INVENTION

According to one aspect of the present invention, there is provided an end-locking device for slide fasteners which enables the rows of zipper teeth to be interlocked by forward movement of the slider without the necessity of holding the ends of the zipper rows by hand or otherwise ensuring that the juxtaposed ends of zipper rows are properly alinged and locked in the socket terminal.

According to a further aspect of the present invention, there is provided an end-locking device for slide fasteners which will not permit the ends of the rows which are located behind the slider to be disengaged unintentionally after the zipper is fastened.

According to a still further aspect of the present invention, there is provided an end-locking device for slide fasteners which facilitates the release of the ends of the rows of zipper teeth on completion of the movement of the slider in the direction required to free the teeth from their engagement.

According to yet another aspect of the present invention, there is provided an end-locking device which comprises a socket terminal disposed at the end of a first row of zipper teeth which is adapted to receive the end of a second row of zipper teeth, including locking means provided with a recessed portion and mounted to pivot on the socket terminal in an opening formed therein; and engaging means having a recessed portion for engaging with the locking means, said engaging means being located at one end of the second row of zipper teeth, wherein the recessed portion of the locking means engages with the recessed portion of the engaging means to releasably lock the end of the second row of zipper teeth so as not to be permitted to escape from the socket terminal when the end of the second row of zipper teeth is fully seated within the socket terminal. When the locking means is caused to pviot, the recessed portions of the engaging means and the locking means are disengaged, and thus the free end of the second zipper teeth row may be pulled out of the socket when the slider is returned to its starting point.

BRIEF DESCRIPTION OF THE DRAWINGS

The present invention will now be described by way of illustrative examples with reference to the accompanying drawings, in which.

DETAILED DESCRIPTION OF THE PREFERRED EMBODIMENTS

Figure 1:
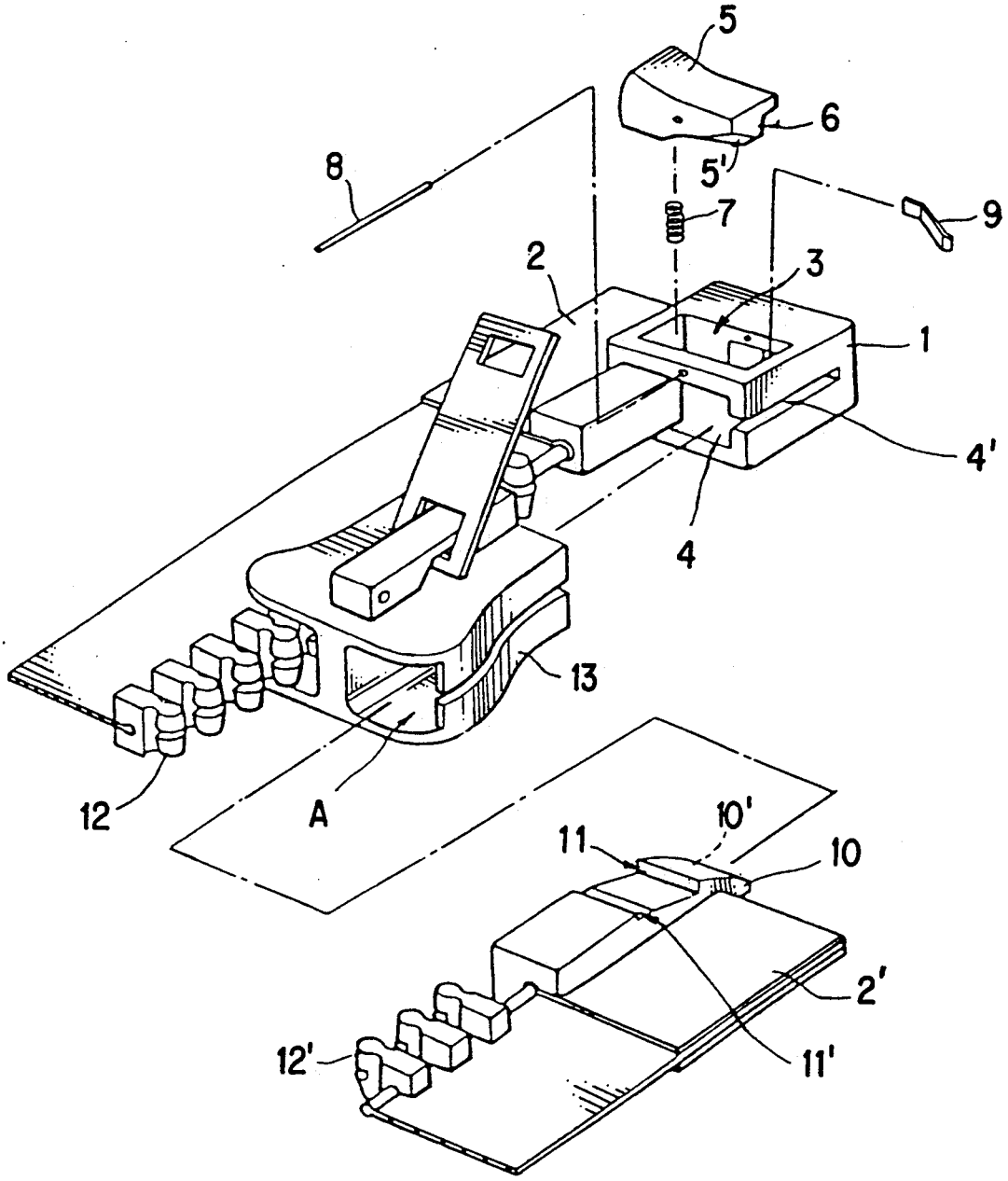
FIG. 1 is an exploded perspective view of a zipper constructed in accordance with an embodiment of the present invention.
Figure 2:
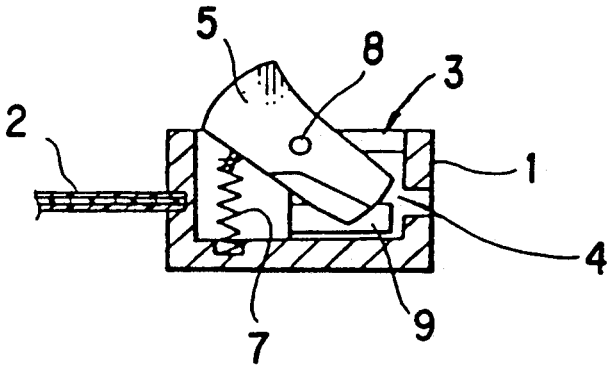
FIG. 2 is a partially sectioned front elevation for the zipper of FIG. 1.

As shown in FIG. 1, a socket terminal member 1 is fixed to the end 2 of the first row 12 of zipper teeth. The socket terminal 1 has an opening 3 for receiving a locking member 5 which acts as a locking means. The socket has a mouth 4 through which the free end 2' of the second row 12' of zipper teeth may be inserted so that both rows meet and are aligned in the socket terminal 1. The locking member 5 is located in the opening 3 and is mounted to pivot on a pivot pin 8. A coil spring 7 is located under the locking member 5 to one side of the pivot pin 8 and serves to urge it upwardly. A recessed portion 11 is formed on an engaging member 10 which is located at the end 2' of the second row 12' of zipper teeth. When the engaging member 10 is inserted into the socket terminal 1 through the mouth 4, the front end of the engaging member 10 advances and its tapered portion 10' pushes the tapered portion 5' of the locking member 5 upwardly. This causes a recessed portion 6 of the locking member 5 to engage the recessed portion 11 of the engaging member 10 and as a result, both of the ends of the rows 12 and 12' of zipper meet and are firmly locked in the socket terminal 1. An end stop 11' which is formed on the top of the engaging member 10 serves to limit the extent to which the engaging member 10 may be inserted into the socket terminal 1.

A leaf spring 9 which is made of a spring steel plate may be fixed to the wall of the opening 3 and acts as an ejector means which serves to urge the engaging member 10 out of the spring 3 when it is fully seated in the opening 3. Thus, when the locking member 5 and the engaging member 10 are disengaged by pushing one side of the locking member downwardly to cause the locking member 5 to pivot, the leaf spring 9 pushes out the rear end of the second row 12' of zipper teeth from the socket terminal 1. As a result, it is unnecessary to pull the rear end of the second row 12' out of the socket terminal 1 by hand on completion of disengagement of the zipper. The width of the end of the second row 12' of zipper teeth may be set corresponding to that of the mouth 4, or may be increased if a side slot 4' is provided on the side wall of the socket terminal as shown in FIG. 1.

Figure 4:
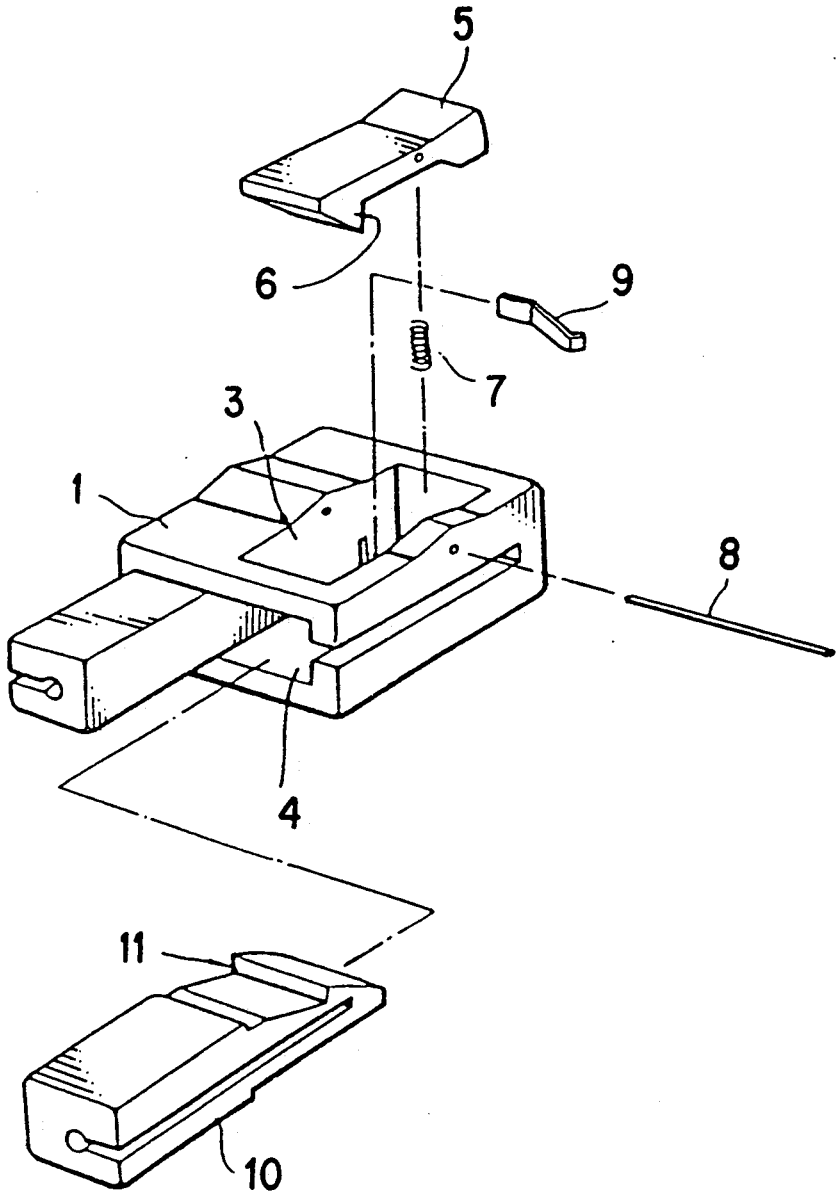
FIG. 4 is an exploded perspective view of a zipper illustrating a further embodiment of the present invention.

In the embodiment of FIG. 1, the opening 3 is formed to communicate with the mouth 4 and the locking member 5 is transversely mounted in the opening 3. The member 5 may be mounted in the opening 3 so that the member 5 pivots in a parallel direction with the zipper rows as shown in FIG. 4.

Figure 3A:
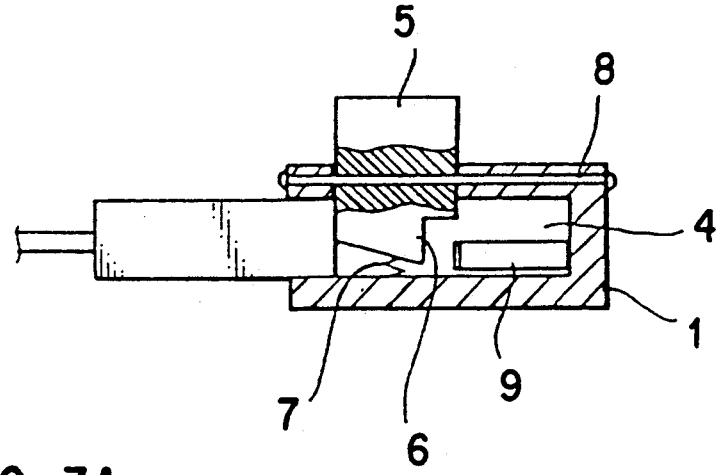
FIG. 3A is a partially sectioned side elevation of the zipper of FIG. 1.
Figure 3B:
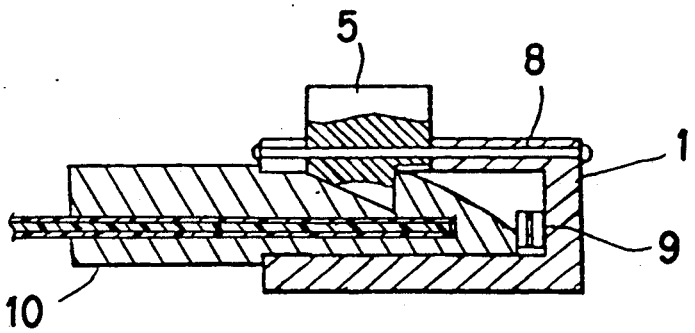
FIG. 3B is a partially sectioned side elevation showing the zipper of FIG. 1 in operative engagement.
Figure 5A:
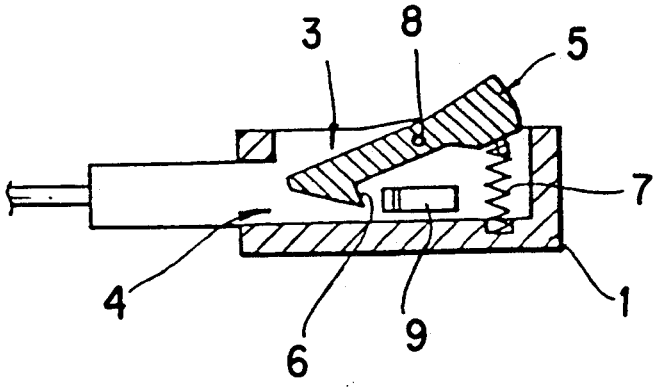
FIG. 5A is a partially sectioned side elevation of the zipper of FIG. 4.
Figure 5B:
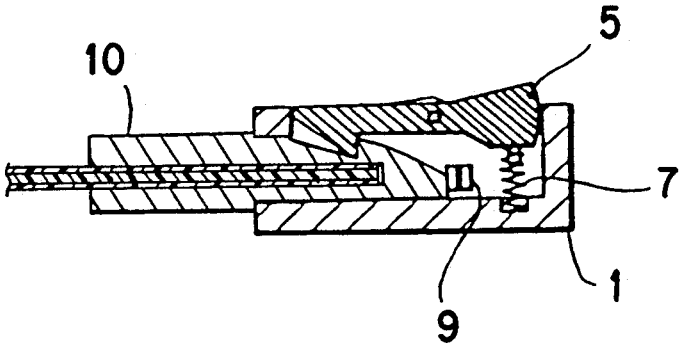
FIG. 5B is a secional side elevation showing the zipper of FIG. 4 in operative engagement.

In order to fasten the zipper, the end of the second row 12' of zipper teeth is first inserted into the mouth 4 of the socket terminal 1 through a port A of the slider 13. In this moment, the recessed portion 6 formed on one side of the locking member 5 maintains lowered position as the other side seated in the opening 3 is urged upwardly by the coil spring 7. Therefore, the engaging member 10 is thrusted into the gap which is made between the tapered portion 5' of the locking member 5 and the bottom of the opening 3, as the member 5 advances into the opening 3. This causes the recessed portion 6 to be lowered and engaged with the recessed portion 11 by means of the spring 7 immediately after the recessed portion 11 passes under the recessed portion 6. In the embodiments, each of the recessed portions 6 and 11 has the shape of right-angled cut section. As a result, the engaging member 10 is firmly locked by the locking member 5 within the socket terminal 1. The locking action of the members 5 and 10 (See FIGS. 3B and 5B) can be recognized by feeling or listening to the ticking sound.

Figure 8:
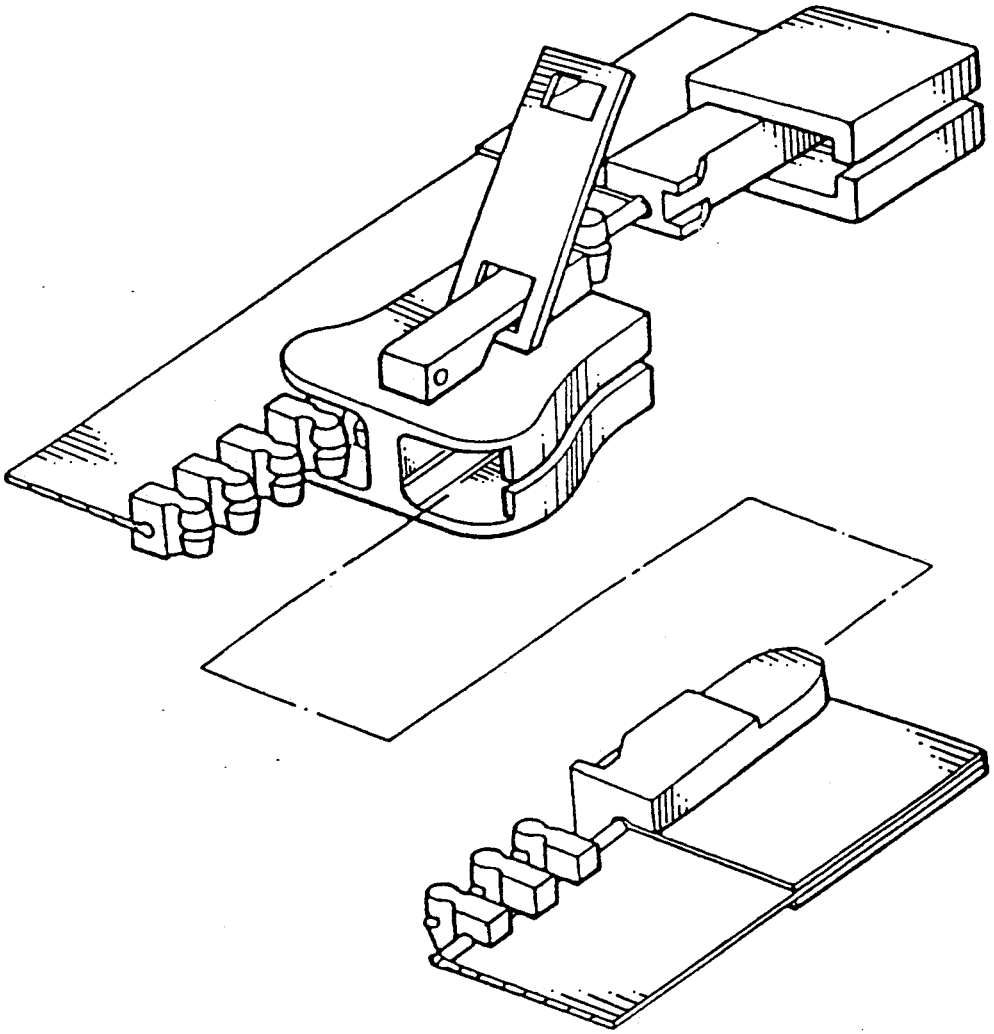
FIG. 8 PRIOR ART
FIG. 8 is an exploded perspective view showing a slide fastener constructed in accordance with the prior art.

After the engaging member 10 is once locked by the locking member 5, the complete locking state is maintained. Therefore, it is possible to bring the rows 12 and 12' of zipper teeth easily into interlocking position by forward movement of the slider 13 without the need of checking the engaged state thereof and holding the end of the second row 12' of zipper teeth in the socket terminal 1, as required in the conventional slide fastener depicted in FIG. 8. In the embodiment of FIG. 1, the front end of the engaging member 10 is urged out of the socket terminal 1 by the leaf spring 9 in the locking state, but the engaging member 10 would not be ejected from the mouth 4 due to the locking engagement between the recessed portion 6 and the recessed portion 11.

In order to unfasten the zipper, the slider 13 is moved toward to the socket terminal 1 and the locking member 5 is caused to pivot by pushing down the opposite side of the recessed portion 6 of the locking member 5. Thus, the recessed portion 11 can be released from the recessed portion 6 and the rear end of the second row 12' of zipper teeth can easily be ejected from the socket terminal 1. In the embodiment of FIG. 1, the leaf spring 9 forces the engaging member 10 out of the terminal 1, when the locking member 5 is caused to pivot.

Figure 6A:
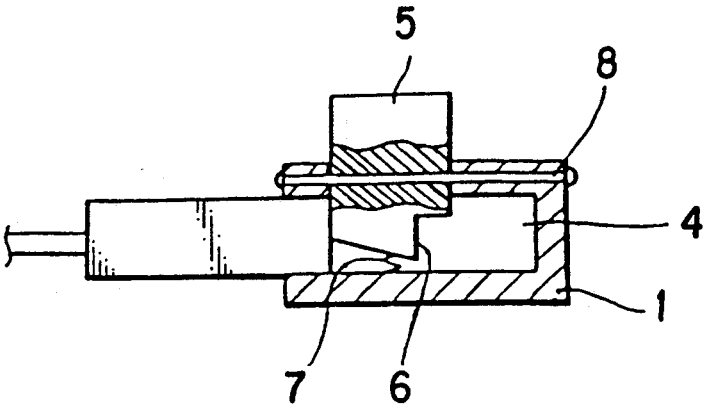
FIG. 6A is a partially sectioned side elevation of a third embodiment of the present invention.
Figure 6B:
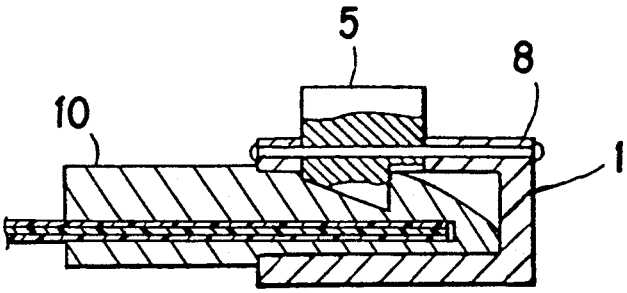
FIG. 6B is a sectional side elevation showing the embodiment of FIG. 6A is operative engagement.
Figure 7A:
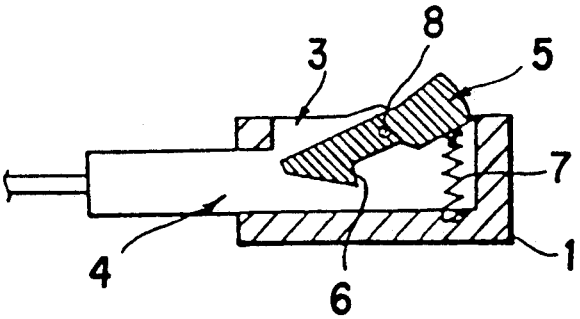
FIG. 7A is a partially sectioned side elevation of a fourth embodiment of the present invention.
Figure 7B:
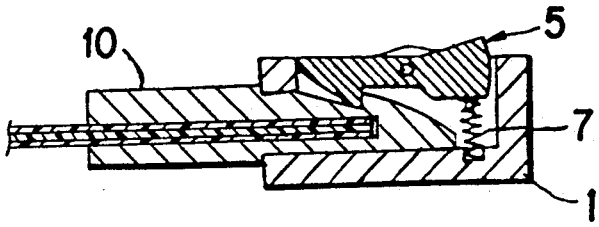
FIG. 7B is a sectional side elevation showing the embodiment of FIG. 7A in operative engagement.

Referring to FIGS. 6 and 7, there are shown other embodiments of the present invention, in which the ejector means as shown in FIG. 1 is not provided. In this embodiments, it is necessary to manually pull out the eagaging member 10 from the mouth 4 when the locking engagement of the members 5 and 10 is released, but they have an advantage that the space for mounting the ejector means is not necessary and hence the whole size of the socket terminal 1 can be reduced.

From the foregoing, it will be apparent that the present; invention provides advantages that it is not necessary to check the locking state during the initial insertion of the free end of the row of zipper teeth into the socket terminal because the free end is properly locked in the socket terminal when fully inserted into the socket terminal and further, the juxtaposed ends of the rows of zipper teeth may not be grasped during forward movement of the slider for fastening the zipper because the locking state would not be released unless the locking means is caused to pivot manually. Moreover, the interlocking engagement of the ends of the rows of zipper teeth can be easily released by pushing one side of the locking member manually.

While the present invention has been described and illustrated herein with reference to the preferred embodiments thereof, it will be understood by those skilled in the art that various changes in form and details may be made therein without departing from the sprit and scope of the invention.

I claim:

1. An end-locking device for slide fasteners comprising;

a socket terminal disposed at one end of a first row of zipper teeth and adapted to receive one end of a second row of zipper teeth through its mouth, said socket terminal including locking means provided with a recessed portion for interlocking engagement and mounted to pivot on said socket terminal in an opening formed therein; and engaging means having a recessed portion for being brought into interlocking engagement with said locking means and located at the end of the second row of zipper teeth, wherein said recessed portion of said locking means engages with said recessed portion of said engaging means to releasably lock the end of the second row of zipper teeth in said socket terminal when the end of the second row of zipper teeth is fully seated within said socket terminal, and the interlocking engagement between said portions is released when said locking means is caused to pivot.

2. The device of claim 1, wherein said locking means is located in said opening and is mounted to pviot on a pivot pin.

3. The device of claim 1, wherein one side of said locking means is urged upwardly by a coil spring located in said socket terminal.

4. The device of claim 1, wherein said locking means has a tapered portion on the opposite side of said recessed portion so as to make an easy entry of said engaging means into said socket terminal.

5. The device of claim 1, wherein each of said recessed portions has the shape of right-angled cut section in order to engage with each other.

6. The device of claim 1, wherein the front end of said engaging means is tapered forwardly and downwardly.

7. The device of claim 1 or 2, wherein said locking means is mounted transversely to said rows of zipper teeth so as to pivot accordingly.

8. The device of claim 1 or 2, wherein said locking means is mounted longitudinally to said rows of zipper teeth so as to pivot accordingly.

9. The device of claim 1, wherein said socket terminal further comprises spring means which serves to urge said engaging means out of said socket terminal when said engaging means is fully inserted into said socket terminal.

10. The device of claim 9, wherein said spring means is a leaf spring installed on the inner wall of said socket terminal.

11. An end-locking device for slide fasteners comprising:

a socket terminal disposed at one end of a first row of zipper teeth, said socket terminal having a first opening and a second opening formed therein, said first opening being formed in a first surface of said socket terminal and positioned transversely to said first row of zipper teeth, said second opening being formed in a second surface of said socket terminal, said first opening and said second opening not being connected together, said first opening being adapted to receive one end of a second row of zipper teeth, said socket terminal including locking means provided with a recessed portion for interlocking engagement and mounted to pivot on said socket terminal in said second opening; and engaging means having a recessed portion for being brought into interlocking engagement with said locking means and located at the end of the second row of zipper teeth, wherein said recessed portion of said locking means engages with said recessed portion of said engaging means to releasably lock the end of the second row of zipper teeth in said socket terminal when the end of the second row of zipper teeth is fully seated within said socket terminal, and the interlocking engagement between said portions is released when said locking means is caused to pivot.

12. The device of claim 11, wherein said locking means is mounted longitudinally to said rows of zipper teeth so as to pivot accordingly.

13. The device of claim 12, wherein said locking means is located in said second opening and is mounted to pivot on a pivot pin.

14. The device of claim 13, wherein one side of said locking means is urged upwardly by a spring located in said socket terminal.

15. The device of claim 14, wherein said locking means has a tapered portion on the opposite side of said recessed portion to thereby ease entry of said engaging means into said socket terminal.

16. The device of claim 15, wherein the front end of said engaging means is tapered forwardly and downwardly.

17. The device of claim 11, wherein said socket terminal further comprises spring means which serves to urge said engaging means out of said socket terminal when said engaging means is inserted in said socket terminal.

18. The device of claim 17, wherein said spring means is a leaf spring installed on the inner wall of said socket terminal.

* * * * *